United States Patent [19]

Reker

[11] 3,963,406

[45] June 15, 1976

[54] SPINNERET ASSEMBLY FOR MULTIFILAMENT YARNS

[75] Inventor: Joseph Robert Reker, Chattanooga, Tenn.

[73] Assignee: E. I. Du Pont de Nemours and Company, Wilmington, Del.

[22] Filed: June 20, 1975

[21] Appl. No.: 588,843

[52] U.S. Cl. ..... 425/463; 264/171; 425/131.5

[51] Int. Cl.[2] ..... D01D 3/00

[58] Field of Search ..... 425/131.5, 462, 463; 264/171

[56] References Cited

UNITED STATES PATENTS

| | | | |
|---|---|---|---|
| 3,006,028 | 10/1961 | Calhoun | 425/131.5 X |
| 3,225,383 | 12/1965 | Cobb | 425/131.5 X |
| 3,584,339 | 6/1971 | Kamachi et al. | 425/131.5 |

*Primary Examiner*—Robert D. Baldwin

[57] ABSTRACT

A spinneret assembly for spinning two melts to form three mixed filament yarns per assembly includes a distribution plate which provides a particular metering function to maintain substantially equal deniers for all three yarns and one conveying channel per melt for maintaining substantially equal deniers for all filaments of the same melt within a given yarn.

2 Claims, 4 Drawing Figures

SPINNERET ASSEMBLY FOR MULTIFILAMENT YARNS

BACKGROUND OF THE INVENTION

This invention relates generally to the production of mixed yarns from two or more distinct varieties of continuous synthetic filaments from molten organic compositions and, more particularly, to a spinneret assembly useful in the spinning process.

Yarns containing two or more distinct varieties of continuous synthetic filaments are used increasingly in the textile industry. The filament varieties may differ in any or all of composition, shrinkage, dyeability, color, electrical conductivity and the like. Intermediate yarns separately spun from the individual compositions are often plied, with or without a filament-intermingling treatment, to create any desired mixed-filament yarn. More recently, mixed filament yarns have been prepared directly during spinning by passing two (or more) polymer melts individually through the same spinning pack to issue simultaneously through spinning capillaries in a single spinneret plate as taught by Reese in U.S. Pat. Nos. 3,593,513 and 3,681,910. The extruded filaments may be wound up with or without additional mechanical drawing and with or without a filament-intermingling treatment.

The design of a spinning pack for extruding two (or more) polymer melts depends on the number of mixed-filament yarns to be produced. The extrusion of a single multifilament mixed-filament yarn is relatively free of complications. Frequently, it is desirable, however, to extrude more than one yarn from the same spinning pack, that is, to provide more than one grouping of spinning orifices in the spinneret plate. It is apparent that proper distribution of two melts to selected spinning orifices in multiple groupings creates design difficulties. Heretofore, in order to maintain symmetry of flow lines involved, it has been the practice to use an even number of groupings, i.e., usually two. The fiber producer ordinarily must modify existing equipment for producing mixed-filament yarns. When a given melt-flow capacity is available, it may result that greatest productivity is obtained only with an odd number (usually three) of groupings of spinning orifices. However, the use of an odd number of orifice groupings has been less than satisfactory because of unacceptable filament-to-filament denier nonuniformities created within each extruded yarn as well as excessive yarn to yarn denier differences.

SUMMARY OF THE INVENTION

The present invention provides a spinneret assembly for the simultaneous melt extrusion of two polymer compositions to form directly an odd number (e.g., three) of multifilament yarns. It further provides a spinneret assembly which alleviates the problems associated with the denier nonuniformities noted above by providing additional metering within the spinneret assembly.

The spinneret assembly of this invention comprises, a distribution plate, a meter plate, and a spinneret plate attached to a filter block as a sandwiched assembly which is mounted for use in known fashion. For each polymer composition, the filter block has a filter cavity communicating via downholes with its exit face. A collection chamber for each polymer composition is formed between the bottom of the filter block and the top of the distribution plate. Concentric annular conveying channels are provided between the bottom of the distribution plate and the top of the meter plate, and a pair of diametrically opposed conduits through the distribution plate connect each conveying channel with one of the collection chambers. The meter plate has a plurality of passages therethrough, each axially aligned with one passage through the spinneret plate, each in communication with only one annular conveying channel, and each sized to have at least twice as much resistance to flow as does the respective passage through the spinneret plate. The meter plate and spinneret plate have an odd number, preferably three, groupings of yarn-forming passages.

Improvements in such a spinneret assembly which provide the improved denier uniformity are:

1. use of only one annular conveying channel per polymer composition, and
2. collection chambers of sufficiently reduced depth to provide a high resistance to melt flow characterized by a Flow Resistance Ratio (R) of at least 0.33 and preferably in the range of 0.5 to 1.5.

wherein $R = \Delta P_2/\Delta P_1$ and $\Delta P_1$ is the pressure drop through a set of passages in a meter plate and a spinneret plate and $\Delta P_2$ is the maximum pressure drop measurable along either collection chamber.

It is preferred that each annular conveying channel have the minimum volume consistent with a flow resistance which is negligible in comparison to that in the associated collection chamber.

DETAILED DESCRIPTION OF THE PREFERRED EMBODIMENT

Figure 1:
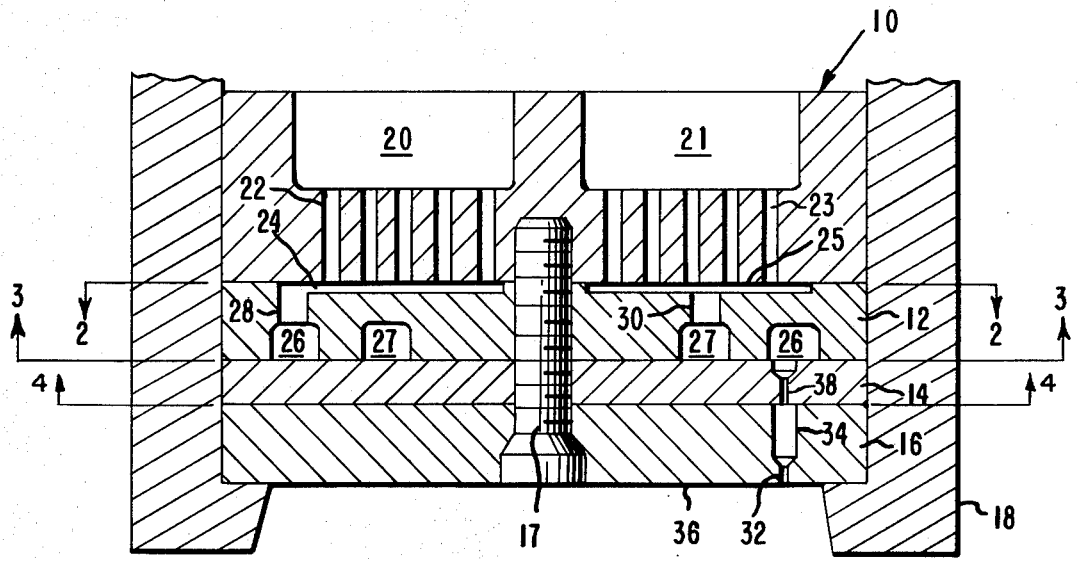
FIG. 1 is a schematic cross sectional view of a spinneret assembly showing related polymer flow passages as applicable to the present invention.

The embodiment illustrated in FIGS. 1–4 includes as components a filter block 10, distribution plate 12, meter plate 14, and spinneret plate 16, all held together by bolt 17 and by a suitable mounting ring 18 which also fastens the assembly to a spinning machine (not shown). Two distinct polymer-melt compositions are supplied to the assembly. (The term "compositions" is used to indicate that the polymer melt may also include minor quantities of customary additives, such as antioxidants, pigments, delusterants, antistats, optical brighteners, etc.).

Filter block 10 has two filter cavities 20, 21 each containing a filtering medium (e.g., sand) and each receiving under pressure a different polymer-melt composition. Filtered melt is discharged from cavities 20, 21 through passages 22, 23 to collection chambers 24, 25, respectively, in the top face of distribution plate 12 (alternatively in the bottom face of filter plate 10). In its bottom face (alternatively in the top face of meter plate 14), distribution plate 12 has conveying channels 26, 27 which are complete annuli. Melt flows from collection chamber 24 to conveying channels 26 via conduits 28, and from collection chamber 25 to conveying channel 27 via conduits 30. Conveying channels 26, 27 conduct the two melts separately to communication with entrances to metering passages 38 through meter plate 14.

Spinneret plate 16 has a plurality of spinning capillaries 32 terminating in its exit face 36 (only one shown in FIG. 1). Normally, each passage through plate 16 comprises a counterbore 34 which tapers to a smaller capillary 32. Each counterbore 34 receives melt via only one of conveying channels 26, 27.

As an aid to improving filament-to-filament denier uniformity, it is known to interpose a meter plate 14 between distribution plate 12 and spinneret plate 16. A meter plate is especially advantageous when capillaries 32 are of complicated shape for producing nonround filaments because of the difficulty in producing such capillaries all with identical resistances to melt flow. For each passage 32, 34 through spinneret plate 16 there is one axially aligned passage 38 through meter plate 14. The resistance to melt flow of passage 38 should be at least twice, preferably several times, as great as the resistance of passage through the spinneret plate. In this way, flow rate through all like capillaries 32 is maintained substantially constant in spite of their unavoidable structural differences. Cobb U.S. Pat. No. 3,095,607 further explains the function and advantages of meter plate 16.

Figure 2:
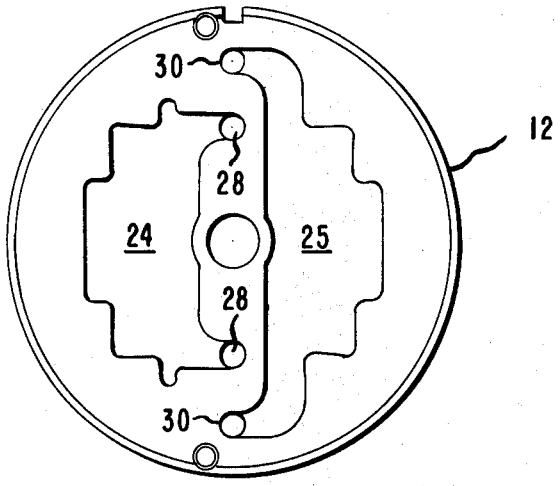
FIG. 2 is a top plan view of the distribution plate of the present invention as it would appear along 2—2 of FIG. 1.
Figure 3:
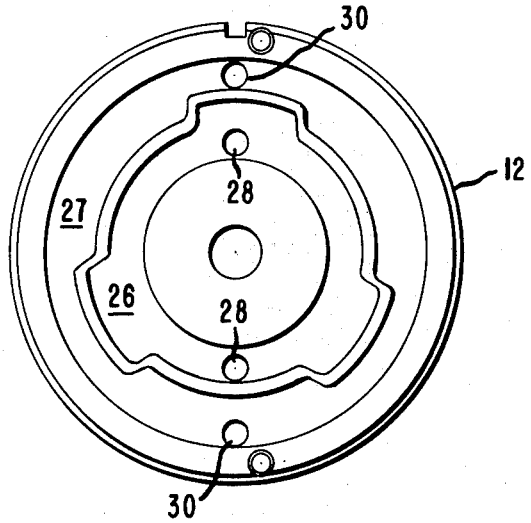
FIG. 3 is a bottom view of the distribution plate of the present invention as it would appear along 3—3 of FIG. 1.
Figure 4:
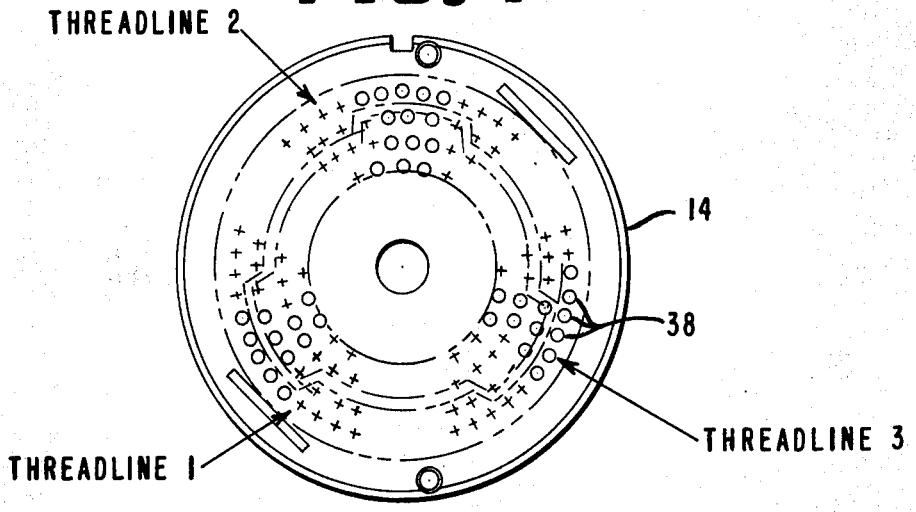
FIG. 4 is a bottom plan view of the meter plate of the assembly as it would appear along 4—4 of FIG. 1 with the outline of the channels of FIG. 3 superimposed.

FIGS. 2–4 show a top plan view (FIG. 2) and a bottom plan view (FIG. 3) of a distribution plate 12 designed for distribution of two polymer melts to each of three arrays of spinning capillaries, each array providing one mixed-filament threadline with 18 filaments of each polymer composition. FIG. 4 is the bottom plan view of corresponding meter plate 14 outlining groups of passages 38 forming threadlines 1, 2 and 3. The passages 38 are supplied with polymer melt by the conveying channels 26, 27 of FIG. 3. It is to be noted that conveying channel 26 is provided for one melt and conveying channel 27 is provided for the other melt.

A preferred high resistance to melt-flow of shallow collection chambers 24, 25 provides an additional metering function in the spinneret assembly with respect to conveying channels 26, 27, respectively, which is entirely analagous to the metering function of meter plate 14 with respect to passages 32, 34 through spinneret plate 16. It is believed that, when the collection chambers 24, 25 provides insufficient metering, regions of reduced melt flow are established in the conveying channels at positions between threadlines 1 and 2 and threadlines 3 and 2. This reduced flow results in longer exposure times at elevated temperature for melts forming threadlines 1 and 3 which, due to time-dependent molecular degradation at elevated temperatures, reduces the flow viscosities of streams forming threadlines 1 and 3. To this end, it is also desirable that each conveying channel have the minimum volume consistent with negligible pressure drop for melt flowing through it.

The absolute depths of collection chambers 24, 25 which provide the necessary metering function cannot be defined precisely because it depends on the viscosity of each particular polymer melt composition being handled. It is defined, instead, as the ratio, R, of two pressure drops, both in the same units. The first ($\Delta P_1$) is the pressure drop measured from the upper face of meter plate 14 to the lower face of spinneret plate 16 along a given set of passages 38, 34, 32. The second ($\Delta P_2$) is the pressure drop measured between any point within a conduit 28 or 30 and the position in collection chamber 24 or 25 under the downhole 22 or 23 which is farthest removed simultaneously from diametrically opposite conduits 28 or 30.

Pressure drop $\Delta P_2$ is then, the maximum pressure drop measurable along either collection chamber. The Flow Resistance Ratio (R) is, then, defined as $$R = \Delta P_2/\Delta P_1.$$

In order that collection chambers 24, 25 provide adequate metering, R should be at least 0.33 and preferably in the range of 0.5 to 1.5.

EXAMPLE

Spinning pack assemblies as shown in FIGS. 1–4 are used to prepare yarns composed of 18 filaments each of PACM-12 homopolymer and PACM-12/PACM-I copolymer. The PACM abbreviation designates the polymer unit corresponding to 4,4′-bis(aminocyclohexyl)-methane; 12 designates the polymer unit corresponding to dodecanedioic acid, and I designates the polymer unit corresponding to isophthalic acid. The copolymer comprises 90% by weight PACM-12 units and 10% by weight PACM-I units, and the PACM employed has 70% by weight trans, trans isomer.

The copolymer and homopolymer are brought to a temperature of 337°C. then pumped in separate streams to filter cavities 20, 21, respectively. The passages, chambers and channels define separate flow paths between the filter block 10 and the spinneret holes 32. The spinneret plate 16 is designed to spin three threadlines (designated 1, 2 and 3, FIG. 4) each having 36 filaments, each filament as drawn and packaged being slightly greater than 1.5 denier and having a trilobal cross section with a 1.9–2.0 modification ratio.

Using the apparatus described with a flow resistance ratio R in the homopolymer portion of the assembly of 0.12 and a flow resistance ratio R in the copolymer portion of 0.09, both being below the preferable range, threadline 2 differs in denier from threadlines 1 and 3 by at least 1.55% with a ratio *r* of about 1.10 (the average denier per filament for the five largest denier filaments of either composition in a given threadline to the average denier per filament of the 13 lowest denier filaments of the same composition). When R (homopolymer) is increased to 0.94 and R (copolymer) to 0.73, the three threadlines differ in denier by less than 1% and *r* remains at about 1.10. Thus, the assembly of this invention provides improved uniformity for mixed-filament spinning of an odd number of threadlines.

What is claimed is:

1. A spinneret assembly comprising sandwiched filter block, distribution plate, meter plate and spinneret plate elements, said filter block, said meter plate and said spinneret plate elements having spaced axially aligned flow passages, said distribution plate being provided with a pair of collection chambers in its upper surface and two concentric annular channels in its lower surface, each one of said pair being in communication with a different one of said concentric annular channels, said chambers and said channels defining separate flow paths between the filter block and the meter and spinneret plate passages; said collection chambers having a resistance to melt flow characterized by a flow resistance ratio R of at least 0.33 wherein $R = \Delta P_2/\Delta P_1$ and $\Delta P_1$ is the pressure drop through a set of flow passages in a meter plate and spinneret plate and $\Delta P_2$ is the maximum pressure drop measurable along either collection chamber.

2. The apparatus as defined in claim 1, said flow resistance ratio R being from about 0.5 to about 1.5.

* * * * *